US005500288A

United States Patent [19]

Isobe et al.

[11] Patent Number: 5,500,288

[45] Date of Patent: Mar. 19, 1996

[54] ALUMINUM SURFACE HAVING CHEMICAL CONVERSION COATING AND METHOD OF FORMING THE COATING

[75] Inventors: Yasuaki Isobe, Nagoya; Hiroyoshi Mizuno, Anjou, both of Japan

[73] Assignee: Nippondenso Co., Ltd., Kariya, Japan

[21] Appl. No.: 88,595

[22] Filed: Jul. 9, 1993

Related U.S. Application Data

[63] Continuation of Ser. No. 796,257, Nov. 22, 1991, abandoned.

[30] Foreign Application Priority Data

Nov. 23, 1990 [JP] Japan ..... 2-320011

[51] Int. Cl.[6] ..... B32B 15/04

[52] U.S. Cl. ..... 428/469; 428/336; 428/470; 428/471; 428/472.2; 106/14.16; 106/14.21; 106/14.44; 252/388; 252/389.1; 252/389.61; 252/389.62

[58] Field of Search ..... 428/336, 469, 428/470, 471, 472.2; 106/14.11, 14.13, 14.14, 14.15, 14.16, 14.18, 14.21, 14.44; 252/387, 388, 389.1, 389.61, 389.62; 148/284, 285

[56] References Cited

U.S. PATENT DOCUMENTS

| | | | |
|---|---|---|---|
| 2,460,897 | 2/1949 | Meyer | 148/264 |
| 3,876,553 | 4/1975 | Kader | 252/389 A |
| 4,098,720 | 7/1978 | Hwa | 252/389 R |
| 4,612,049 | 9/1986 | Berner | 106/14.13 |
| 4,828,616 | 5/1989 | Yamasoe | 106/14.13 |
| 4,961,878 | 10/1990 | Mullins | 252/389.3 |

FOREIGN PATENT DOCUMENTS

| | | |
|---|---|---|
| 52-42434 | 4/1977 | Japan . |
| 118531 | 4/1977 | Japan . |
| 1081282 | 8/1967 | United Kingdom . |
| 1309577 | 3/1973 | United Kingdom . |
| 1483283 | 8/1977 | United Kingdom . |
| 1501842 | 2/1978 | United Kingdom . |
| 2084614 | 4/1982 | United Kingdom . |
| 2139250 | 11/1984 | United Kingdom . |
| 2195358 | 4/1988 | United Kingdom . |
| WO00579 | 3/1981 | WIPO . |

OTHER PUBLICATIONS

JP 520042434 A (Showa) Derwent English Abstract, Apr. 1977.

*Primary Examiner*—Ellis P. Robinson
*Assistant Examiner*—Timothy M. Speer
*Attorney, Agent, or Firm*—Cushman, Darby & Cushman

[57] ABSTRACT

A chemical conversion coating formed on a surface of an aluminum substrate. The coating comprises a composite material formed by a reaction of a nitrate or sulfate of an alkali metal or alkaline earth metal and an organic compound that can form a compound with aluminum or exhibit a weak basicity an an aqueous aluminum treating liquid comprising the nitrate or sulfate of alkali metal or alkaline earth metal and the organic compound, with the aluminum substrate. The coating is corrosion-resistant, bacteria-proof or fungiproof, and the surface is of a heat exchanger, etc.

5 Claims, 2 Drawing Sheets

ALUMINUM SURFACE HAVING CHEMICAL CONVERSION COATING AND METHOD OF FORMING THE COATING

This is a continuation of application Ser. No. 07/796,257, filed Nov. 22, 1991, which was abandoned on Jul. 9, 1993.

BACKGROUND OF THE INVENTION

1. Field of the Invention

This invention relates to a chemical conversion coating formed on a surface of an aluminum substrate; the coating being corrosion-resistant or bacteria-proof or fungiproof, and the surface belonging to a heat exchanger, etc.

2. Description of the Related Art

The forming of a corrosion-resistant coating on a surface of an aluminum product such as an aluminum heat exchanger is known. For example, Japanese Patent Application Laid-open (Unexamined) No. Sho 52-42434 (1977) discloses a method of forming a corrosion-resistant chemical conversion coating on an aluminum surface by dipping an aluminum surface in a treatment solution comprising an alkaline earth metal salt, an alkali metal sulfate and a carbonate or a bicarbonate. Nevertheless, the surface having the chemical conversion coating does not exhibit a sufficient corrosion resistance in a corrosive environment, e.g., that which causes an adhesion of an aqueous solution containing chloride ions, such as seawater to the surface.

SUMMARY OF THE INVENTION

An object of the invention is to provide a chemical conversion coating on a surface of an aluminum substrate, resistant to a highly corrosive solution and a method of forming such a coating on a surface of an aluminum substrate.

Another object is to provide a bacteria-proof or fungiproof chemical conversion coating on a surface of an aluminum substrate, and a method of forming such a coating on a surface of an aluminum substrate.

In accordance with this invention, a surface of an aluminum substrate to be treated is placed in contact with an aqueous treatment solution comprising at least one salt selected from sulfates or nitrates of alkali metals or alkaline earth metals and at least one of organic compounds which form a compound with aluminum or exhibit a basicity in the treatment solution, to form a chemical conversion coating on a surface of aluminum substrate.

Namely, the chemical conversion coating on the surface of aluminum substrate comprises a basic double salt including aluminum ions, at least one metal ion selected from alkali metal ions or alkaline earth metal ions, at least one ion selected from nitrate ions or sulfate ions, and ion of at least on organic compound selected from the organic compounds.

DESCRIPTION OF THE PREFERRED EMBODIMENTS

Figure 1:
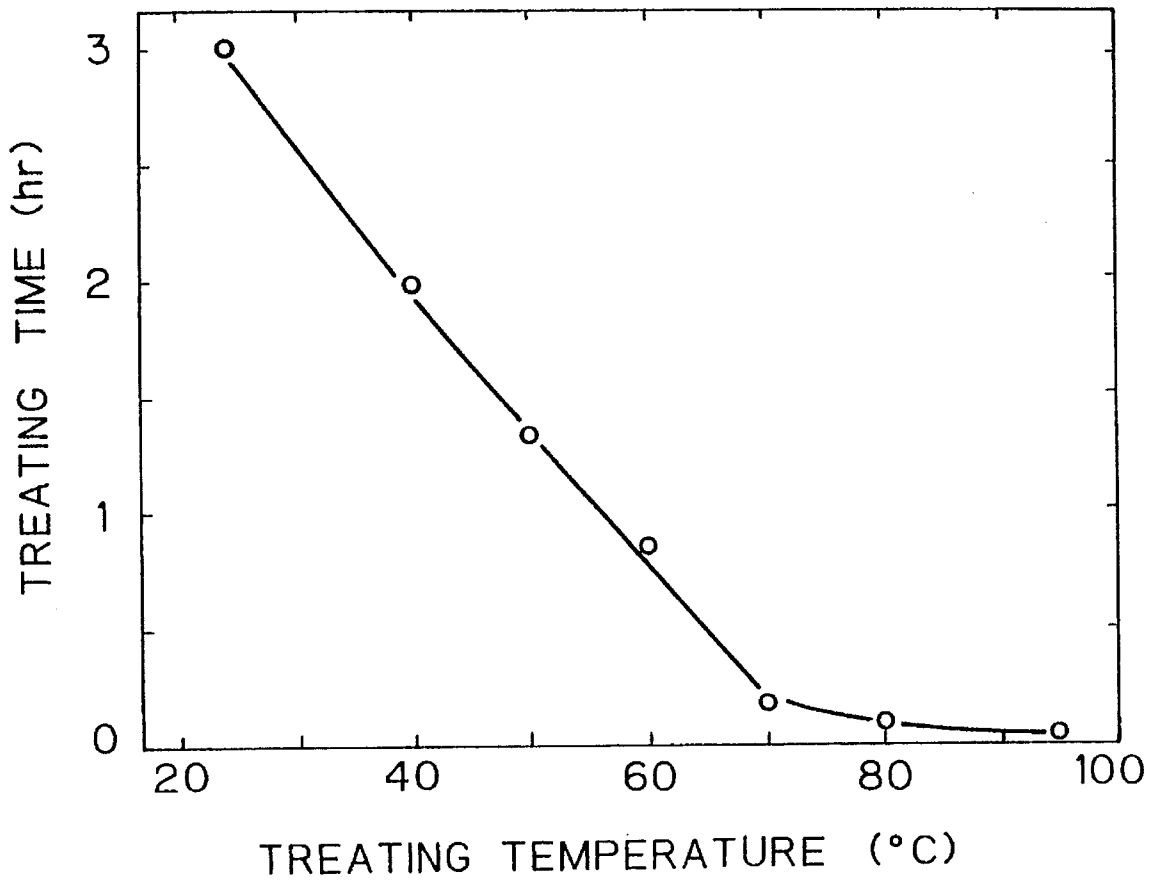
FIG. 1 is a graph showing a relationship between treating temperature and treating time when forming the about 2 μm thick chemical conversion coating of this invention.

The chemical conversion coating of the present invention can isolate the aluminum substrate from a corrosive environment, and can have a bacteria-proof or a fungiproof property when a bacteria-proof or a fungiproof compound is used as the above organic compound.

In this invention, examples of the sulfates or nitrates of alkali metals or alkaline earth metals are magnesium sulfate ($MgSO_4$), magnesium nitrate ($Mg(NO_3)_2$), Lithium sulfate ($Li_2SO_4$), Lithium nitrate ($LiNO_3$), and the like. Also, in this invention, examples of the organic compounds that form compounds with aluminum or exhibit a basicity in the treatment solution, are sodium mercaptobenzothiazole (hereinafter abbreviated as "SMBT"), oxine, sodium oxalate, triethanolamine, sodium benzoate. The chemical formulae of these organic compounds are as follows:

SMBT:

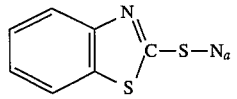

oxine:

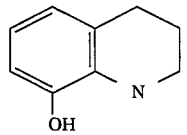

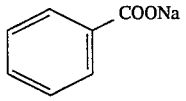

A desirable combination comprises $MgSO_4$ and SMBT.

The reason why the above organic compounds are qualified by exhibiting a weak basicity in the treatment solution although they do not form compounds with aluminum is because, although aluminum is easily dissolved in a basic solution, it is better for the solution to be neutral in order to precipitate the dissolved aluminum ion in a form of basic double salts. Thus weak basicity not only dissolves aluminum promptly but also forms basic double salts coat promptly.

In this invention, the organic compound exhibits basic in the treatment solution, and preferably exhibits a weak basicity with a pH of 8–10 in view of the formation of a coating on aluminum.

In this invention, among the above organic compounds, sodium mercaptobenzothiazole, oxine and sodium benzoate have bacteria proof and fungiproof properties.

As different kinds of organic compounds having bacteria proof and fungiproof properties from the above organic compounds, propyl p-hydroxy benzoate and dichloronaphthoquinon can be mentioned. The chemical formulae thereof are as follows:

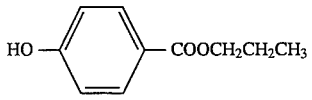

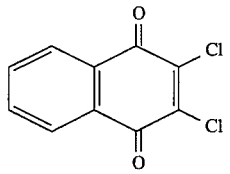

In this invention, by using an organic compound having bacteria proof and fungiproof properties, it becomes possible to inhibit the propagation of microorganisms even when microorganisms in the air are adhered to an evaporator of, for example, an automobile cooler. Thus it becomes possible to reduce the unpleasant odor due to the oxidation and decomposition of the microorganisms at the initial stage of using the cooler.

In this invention the concentration of the sulfate or nitrate of alkali metal or alkaline earth metal is suitably about 0.001 M—about 5 M, and preferably about 0.005 M—about 1 M. When the concentration is lower than 0.001 M, the formation of the coating is insufficient. On the other hand when the concentration is higher than 5 M, precipitation occurs. Thus said concentration is preferably not outside this range.

In this invention, the concentration of the organic compound forming an aluminum compound or exhibiting basicity in the treating solution is preferably about 0.001 M—about 5 M, more preferably about 0.005 M—1 M. When said concentration is lower than 0.001 M, the formation of the chemical conversion coating is insufficient. When said concentration is higher than 5 M, only the aluminum may be dissolved, and thus the chemical conversion coating not formed.

Contact of the treating liquid with the surface of the aluminum substrate is generally accomplished by dipping the aluminum substrate in the boiling treating solution. The dipping time is preferably 1–60 minutes. When the time is shorter than 1 minute the formation of the chemical conversion coating may be insufficient. On the other hand, when the time exceeds 60 minutes, there is little increase in the thickness of the coating.

The thickness of the coating is preferably 0.1 μm to 20 μm or more. When the thickness of the coating is thinner than 0.1 μm, it may be insufficient to protect the aluminum substrate from a corrosive environment. On the other hand when it is thicker than 20 μm, the effect of the coating is not greatly increased, and it is time consuming.

The temperature of the treating liquid at the time of contacting the aluminum is preferably in the range of from room temperature to boiling temperature for treating convenience. Further, since the coating forms at room temperature, only the addition of the treating agent of this invention to an operational liquid can bring about the same effect as the chemical conversion treatment. From FIG. 1 it can be seen that the higher the temperature of the treating liquid, the shorter the treatment time.

In this invention the aluminum includes aluminum alloy, for example, A1050, A2017, A3003, A5052, A6061, A7072, BA4045 of JIS standard.

Figure 2:
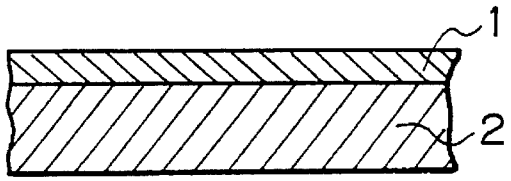
FIG. 2 is a cross sectional schematic view of the chemical conversion coating on a surface of an aluminum substrate.

FIG. 2 is a cross sectional schematic view of the surface of the aluminum substrate having a chemical conversion coating thereon. In this figure, 1 is the chemical conversion coating, and 2 is the aluminum substrate.

The surface having the chemical conversion coating of this invention can be applied to a heat exchanger, which includes an automobile radiator, a core of an automobile hot water heater, an evaporator of an automobile cooler, and a condenser thereof. Of course its use is not limited to the application of automobiles, and it is also applicable to a device other than a heat exchanger.

Figure 3:
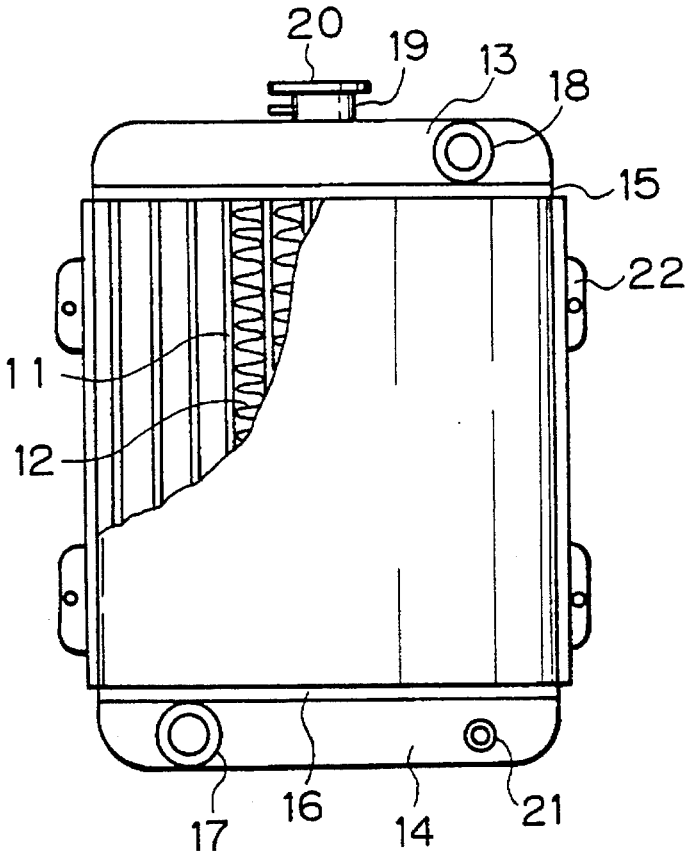
FIG. 3 is a front view of a radiator for automobiles, a portion thereof being cut away to reveal the section pertaining to the application of this invention.

A constitution of a radiator for an automobile is shown in FIG. 3, wherein 11 are tubes for passing a cooling medium, 12 are corrugated fins joined by brazing to tubes 11, 13 is an upper tank, 14 is a lower tank, and the tubes 11 are joined to the tanks 13 and 14 by brazing. 15 and 16 is a core plate respectively, 17 is an exit pipe, 18 is an entrance pipe, 19 is a water feeding entrance, 20 is a cap for the feeding entrance, 21 is a drain pipe, 22 are brackets for attachment.

Hereinafter this invention will be illustrated by examples, but the invention defined in the claims is not limited to these examples.

Example 1

A treatment solution is prepared as an aqueous solution consisting of 0.02 M of magnesium sulfate ($MgSO_4$), 0.02 M of SMBT and water, and the liquid is maintained at a temperature of 95° C. In the treatment solution a board (BA4045 of JIS standard), which is a member to be brazed, of an aluminum heat exchanger. The BA4045 is an alloy having a composition of 90% of aluminum and 10% of silicon, which is generally covered over a surface of a core board for the sake of brazing.

During the dipping process, on a surface of the BA4045, a porous chemical conversion coating is formed. The chemical conversion coating is of a complex composition comprising, for example, A1, $SO_4$, OH and mercaptobenzothiazole (MBT).

The above BA4045 board formed of the chemical conversion coating is dipped for two weeks in a corrosive aqueous solution containing 0.01 M of NaCl. Further, the aqueous solution is kept at a temperature of 40° C., a pH of between 6 and 8 and in a bubbling state by aeration.

After the above dipping, the BA4045 board was tested for corrosion potential, pitting potential and maximum pitting depth. The corrosion potential was determined by the known potentiostat, and the pitting potential was determined by the dynamic potential method (the potential scanning rate: 20 mV/min). The results are shown in Table 1.

Comparative Example 1

The same BA4045 board used in Example 1 is dipped for 30 minutes in a chemical conversion treatment solution containing 0.05 M of $MgSO_4$ and 0.005 M of $NaHCO_3$ and retained at 90° C. (a method described in Japanese Patent Application Laid-open No. Sho 52-42434 (1979)).

By this treatment, a chemical conversion coating is formed on the surface of the BA4045 board. The coating is a cohesive material of hydrated aluminum oxide combined with $MgCO_3$.

The above board was dipped in a corrosive aqueous solution having the same composition as Example 1 for the same duration as Example 1, and the corrosion potential, pitting potential and maximum pit depth of the board were determined in the same way as Example 1. The results are shown in Table 1.

Comparative Example 2

A non-treated BA4045 board was dipped in a corrosive aqueous solution having the same composition as Example 1 for the same duration as Example 1, and the corrosion potential, pitting potential and maximum pit depth of the board were determined in the same way as Example 1. The results are shown in Table 1.

TABLE 1

| | Corrosion Potential (V VS Ag/AgCl) | Pitting Potential (V VS Ag/AgCl) | Maximum Pit Depth (mm) |
|---|---|---|---|
| Example 1 | −0.90 | −0.35 | <0.01 |
| Comparative Example 1 | −0.50 | −0.52 | 0.32 |
| Comparative Example 2 | −0.58 | −0.58 | 0.28 |

It is understood from Table 1 that the board of the Example 1 of this invention has a low corrosion potential, a high pitting potential and a small maximum pit depth, thus it is excellent in corrosion resistance.

Since the BA4045 board is an alloy of Al-Si; eutectic type, silicon (Si) is liable to crystallize. Since the crystallized silicon promotes the reduction reaction of the dissolved oxygen, which is the opposite reaction of an aluminum dissolution reaction in a corrosive aqueous solution of NaCl, the BA4045 board has a poor corrosion resistance.

Since the crystallized silicons have diameters as large as 10 μm, the coating formed by such a chemical conversion treatment, as in Comparative Example 1, can not sufficiently cover the said silicons.

On the contrary, it is believed that in Example 1 of the present invention, since at the time Al ion and Mg ion form a chemical conversion coating together with a sulfate ion and a hydroxyl ion, they also combine with mercaptobenzothiazole (MBT), and a thicker coating forms that covers the crystallized silicons. Therefore, in Example 1, since a chemical conversion coating capable of covering the crystallized silicons completely can be formed, the corrosion potential of an aluminum member can be made far lower than the pitting potential. Thus, the maximum pit depth becomes extremely small as is shown in Table 1, and the corrosion resistance of aluminum substrate can be increased.

Example 2

An aqueous solution containing 0.05 M of $MgSO_4$ and 0.05 M of SMBT was prepared and maintained at a temperature of 95° C. A previously washed heat exchanger made of aluminum was dipped in the above aqueous solution for about 30 minutes, then dried at 180° C. in a hot air dryer for 30 minutes, to form a synthetic coat containing SMBT, Al and Mg on the surface of an aluminum alloy of the heat exchanger.

Next, microorganisms were adhered on the surface of the aluminum alloy surface of the above surface treated heat exchanger, and the number of the microorganisms was counted after culture. The microorganisms used were those adhered to an evaporator of a cooler for an automobile obtained from a market. The name of the microorganisms are as follows:

(Bacteria)

Bacillus subtilus, Pseudomonas sp,

Alcaligenes sp, Enterobacter sp, Acinetobacter.

(Fungi)

Aspergillus niger, Alternalia citrinum, p-enicillium citrinum, Cladosporium sp,

Penicillium sp, Asperigllus sp.

Next, the following glucose culture solution was prepared.

| | |
|---|---|
| $KH_2PO_4$ | 1.0 g |
| $MgSO_4$ | 0.5 g |
| NaCl | 0.1 g |
| $CaCl_2.2H_2O$ | 0.1 g |
| Potato extracted liquid | 0.4 g |
| Glucose | 1.0 g |
| Agar | 1.0 g |
| $H_2O$ (total) | 1000 ml |

After suspending the above microorganisms in the above culture solution, controlling the number of bacteria being at least $10^7$/ml and the number of fungi being at least $10^6$/ml, the microorganic culture solution was spray coated on the whole surface of the above chemical conversion treated heat exchanger.

After spray coating the heat exchanger was stored in a desiccator at 28° C.±2° C. for 20 days and the microorganisms were cultured.

After the culture, the heat exchanger is immersed in sterile water sterilized by boiling in a steam sterilizer at 121° C. for 15 minutes. Then 0.5 ml of the resultant water is sampled.

A physiological salt solution is prepared, sterilized at 120° C. for 15 minutes and distributed by 4.5 ml to all of the 7 test tubes. 0.5 ml of the above sampled sterile water is put into the first test tube, then 0.5 ml is sampled from the first test tube and put into the second tube, repeating the same procedure until the seventh test tube, so that the first sample is diluted stepwise ten times by ten times. Thus the concentration of the 7th test tube becomes $10^{-7}$ of the originally sampled sterile water.

Next, samples are taken twice by 1 ml from each test tube and distributed to 14 laboratory dishes, mixed with a culture medium (agar) and cultured respectively. Seven laboratory dishes out of 14 are used for bacteria and the remaining 7 laboratory dishes are used for fungi. The bacteria are cultured at 28° C.±2° C. for 48–72 hours, and the fungi are cultured at 28° C.±2° C. for 120 hours.

Then microorganic colonies on the culture medium in the laboratory dish charged with the sample diluted to $10^{-7}$ times or taken from the 7th test tube are observed by visual observation and numbered. As the number of colonies is the number of the microorganisms in the sample of the $10^{-7}$ diluted concentration, the original number of microorganisms or the number of the microorganisms of the original sterile water sample is equal to the number of the colonies× $10^7$, as shown in Table 2.

Comparative Example 3

Chromate chemical conversion treating agent for aluminum (ALCHROM™ 20 M, manufactured by Nihon Parkerizing Co., Ltd.) is dissolved in water at a rate of 72 g/l and maintained at 50° C. In this aqueous solution, the same heat exchanger as used in Example 2 (previously washed), is dipped for two minutes, to form a chromic chromate chemical conversion coating (adhering amount of chromic acid is 100 mg/m$^2$) on the surface of the heat exchanger.

The same microorganic culture solution as Example 2 was spray coated on the chromate chemical conversion coating of the heat exchanger, and the numbers of bacteria and fungi were determined in the same way as in Example 2. The results are shown in Table 2.

Comparative Example 4

The same microorganic culture solution as Example 2 was spray coated on the whole surface of the same heat exchanger as used in Example 2 but without any chemical conversion coating. Thereafter the numbers of bacteria and fungi were determined in the same way as Example 2. The results are shown in Table 2.

TABLE 2

| | Number of Bacteria ($/cm^2$) | Number of Fungi ($/cm^2$) |
|---|---|---|
| Example 2 | 240 | 3 |
| Comparative Example 3 | 17000 | 2400 |
| Comparative Example 4 | 12000 | 1800 |

As is realized from Table 2, the Example 2 of this invention can inhibit propagation of microorganisms in comparison with Comparative Examples 3 and 4, thus it can suppress the unpleasant odor due to oxidation and decomposition of the microorganisms.

Example 3

A board of JIS A1050, a industrial pure aluminum, is dipped in the same treating liquid as used in Example 1 for 30 minutes, forming the same chemical conversion coating as Example 1. The A1050 board applied with the chemical conversion coating is dipped in a corrosive aqueous solution containing 0.01 M of dissolved NaCl and 30 ppm of dissolved copper ion ($CuSO_4$) for 2 weeks. The aqueous solution is maintained at a temperature of 40° C. and a pH of 7 and bubbled by blowing air.

The board of A1050 after dipping was tested for maximum pit depth. The determined maximum pit depth was 0.01 mm, which is extremely small.

Comparative Example 5

The same aluminum board as in Example 3 but without any chemical conversion coating was dipped in the same aluminum board for the same duration as Example 3, and tested for maximum pit depth which was about 0.2 mm.

As apparent from the Examples, the chemical conversion coating of this invention can improve the corrosion resistance of aluminum against highly corrosive components such as chloride ion and copper ion. Further the corrosion resistant chemical conversion coating of this invention can inhibit the propagation of microorganisms adhered thereto, so it can suppress the unpleasant odor due to oxidation and decomposition of the microorganisms. Thus the coating of the present invention is convenient for a corrosion resistant chemical conversion coating of, for example, an evaporator of a cooler of an automobile.

We claim:

1. A corrosion resistant chemical conversion coating formed on a surface of an aluminum substrate, comprising a basic double salt including aluminum ions, at least one salt selected from the group consisting of sulfates of alkali metal ions or alkaline earth metal ions, at least one organic compound selected from the group consisting of sodium mercaptobenzothiazole, oxine and sodium benzoate, wherein the coating has a thickness of not less than 0.1 μm; said conversion coating being prepared from an aluminum-treating aqueous solution comprising said sulfates of alkali metal ions or alkaline earth metal ions at a concentration of from about 0.001 M to about 5 M, and said organic compound at a concentration of from about 0.001 M to about 5 M.

2. A corrosion resistant chemical conversion coating formed on a surface of an aluminum substrate, consisting essentially of a composite material formed by a reaction, with the aluminum substrate, of at least one salt selected from the group consisting of sulfates of alkali metals and alkaline earth metals and at least one organic compound selected from the group consisting of sodium mercaptobenzothiazole, oxine and sodium benzoate, wherein the coating has a thickness of not less than 0.1 μm; said conversion coating being prepared from an aluminum-treating aqueous solution consisting essentially of said sulfates of alkali metals or alkaline earth metals at a concentration of from about 0.001 M to about 5 M, and said organic compound at a concentration of from about 0.001 M to about 5 M.

3. A chemical conversion coating according to claim 2 that protects the aluminum substrate from a liquid containing chloride ion or copper ion.

4. A chemical conversion coating according to claim 2, where said salt is magnesium sulfate, and said organic compound is sodium mercaptobenzothiazole.

5. A chemical conversion coating according to claim 2, wherein said alkali metal is lithium or said alkaline earth metal is magnesium.

* * * * *